United States Patent [19]

Terauchi et al.

[11] 4,406,600

[45] Sep. 27, 1983

[54] SCROLL-TYPE FLUID DISPLACEMENT APPARATUS WITH ROTATION PREVENTION/THRUST BEARING MEANS FOR ORBITING SCROLL MEMBER

[75] Inventors: Kiyoshi Terauchi, Isesaki; Seiichi Sakamoto, Gunma, both of Japan

[73] Assignee: Sanden Corporation, Gunma, Japan

[21] Appl. No.: 249,656

[22] Filed: Mar. 31, 1981

[30] Foreign Application Priority Data

Apr. 5, 1980 [JP] Japan ..... 55-44072

[51] Int. Cl.[3] ..... F01C 1/02; F01C 17/00; F01C 21/02; F16D 3/04

[52] U.S. Cl. ..... 418/55; 464/102

[58] Field of Search ..... 418/55, 57; 464/102, 464/104, 103, 105; 308/233; 384/303

[56] References Cited

U.S. PATENT DOCUMENTS

| | | | |
|---|---|---|---|
| 2,813,409 | 11/1957 | Wolcott | 464/102 |
| 3,924,977 | 12/1975 | McCullough | 418/55 |
| 4,121,438 | 10/1978 | McCullough | 64/31 |
| 4,160,629 | 7/1979 | Hidden et al. | 418/55 |
| 4,259,043 | 3/1981 | Hidden et al. | 418/55 |

*Primary Examiner*—John J. Vrablik

*Attorney, Agent, or Firm*—Schuyler, Banner, Birch, McKie & Beckett

[57] ABSTRACT

A scroll-type of fluid displacement apparatus is disclosed. The apparatus includes a housing having a fluid inlet and a fluid outlet port. A fixed scroll member is fixedly disposed with respect to the housing and has an end surface from which a first wrap extends. An orbiting scroll member is movably disposed within the housing and has an end plate from which a second wrap extends. The first and second wraps interfit at an angular offset to make a plurality of line contacts which define at least one pair of sealed off fluid pockets. A drive mechanism is connected to the orbiting scroll member to transmit orbital motion thereto. A rotation preventing means prevents rotation of orbiting scroll member during orbital motion of the orbiting scroll member and is comprised of fixed ring and a sliding ring. The sliding ring is slidably connected to the fixed ring and also to the second end plate by keys and keyways. A plurality of pockets is formed through the sliding ring and bearing elements are retained within the pockets for transmitting axial thrust load from the orbiting scroll member to the fixed ring.

23 Claims, 9 Drawing Figures

40
L2
A
11
34
Od
303
112
154
E2
Oc
151
L1
E1
Os
33
15
152
331
40

SCROLL-TYPE FLUID DISPLACEMENT APPARATUS WITH ROTATION PREVENTION/THRUST BEARING MEANS FOR ORBITING SCROLL MEMBER

BACKGROUND OF THE INVENTION

This invention relates to rotary fluid displacement apparatus, and in particular, to fluid compressor units of the scroll type.

Scroll-type apparatus are well known in the prior art. For example, U.S. Pat. No. 801,182, discloses a device including two scroll members each having an end plate and a spiroidal or involute spiral element. The scroll members are maintained angularly and radially offset so that both spiral elements interfit at a plurality of line contacts between their spiral curved surfaces, to thereby seal off and define at least one pair of fluid pockets. The relative orbital motion of these scroll members shifts the line contact along the spiral curved surfaces and, therefore, changes the volume in the fluid pockets. The volume of the fluid pockets increases or decreases dependent on the direction of orbital motion. Therefore, a scroll type apparatus is applicable to compress, expand or pump fluids.

Sealing along the line contact must be maintained because the fluid pockets are restricted or defined by the line contact between the two spiral elements and, as line contact shifts along the surface of spiral elements, the fluid pocket changes volume by the relative orbital motion of the scroll members. In some prior art devices, both scroll members are supported on a crank pin or shaft which is disposed at end portions of drive shafts to accomplish the relative orbital motion between the scroll members. The scroll members are thereby supported in a cantilever manner. Therefore, a slant may arise between the drive shafts and the cantilever supported scroll members, whereby axial line contact between the spiral elements is not maintained. In other prior art devices, one of the scroll members is fixedly disposed in a housing and the axial slant of the scroll member is thereby prevented. However, the other scroll member must be supported on the crank pin of the drive shaft, therefore, axial slant of this scroll member by the cantilever support is not resolved. In addition, the movement of the orbiting scroll member is not rotary motion around the center of the scroll member, but is orbiting motion caused by the eccentrical movement of the crank pin moved by the rotation of the drive shaft, therefore axial slant easily arises. When the axial slant occurs several problems arise; primarily sealing of the line contact, vibration of the apparatus during operation and noise caused by striking of the spiral elements.

SUMMARY OF THE INVENTION

It is a primary object of this invention to provide a scroll-type fluid apparatus wherein a rotation preventing mechanism of the orbiting scroll member is provided with a mechanism for preventing axial slant of the orbiting scroll member.

Another object of this invention is to provide a small size and vibration-less scroll-type apparatus wherein sealing of the fluid pocket is secured.

Still another object of this invention is to provide a scroll-type apparatus which is simple in construction, yet realizing the above described objects.

A scroll-type fluid displacement apparatus according to this invention includes a housing having a fluid inlet port and a fluid outlet port. A fixed scroll member is fixedly disposed within the housing and has first end plate means from which a first wrap extend. An orbiting scroll member has a second end plate means from which second wrap means extend. The first and second wrap means interfit at an angular offset to make a plurality of line contacts to define at least one pair of sealed off fluid pockets. A drive mechanism is connected to the orbiting scroll member to transmit orbital motion to the orbiting scroll member. The fluid pockets change volume due to the orbital motion of the orbiting scroll member. A rotation preventing/thrust bearing means is disposed in the housing, for preventing the rotation of the orbiting scroll member but still allowing the orbital motion of the orbiting scroll member. The rotation preventing/thrust bearing means is comprised of a fixed ring and a sliding ring. The fixed ring is secured to the inner surface of the housing and is opposed to the second end plate of the orbiting scroll member. The sliding ring is disposed in a hollow space between the fixed ring and the second end plate and is slidably connected to the fixed ring by keys and keyways for movement in a first direction of a diameter. The sliding ring is also slidably connected to the second end plate means by keys and keyways for movement in a second direction of a diameter perpendicular to the first direction. The sliding ring is formed with a plurality of spaced axial penetrating pockets. The pockets retain a bearing element, whereby the thrust load from the orbiting scroll member is supported on the fixed ring through the bearing elements.

In one embodiment of the invention, the bearing elements are comprised of a plurality of balls. The fixed ring and the second end plate means which function as race surfaces of the balls have circular indentations or annular grooves on their surfaces for receiving the balls and restricting the radius of the ball movement. Therefore, the balls follow the movement of the orbiting scroll member, whereby correct circular rolling movement of balls is assured.

In another embodiment of the invention, the bearing elements are comprised of a plurality of sliding discs. The sliding discs are held in the pockets and have two parallel end surfaces. One end surface contacts the surface of the fixed ring and the other end surface contacts the second end plate means. The sliding disks are thereby held in such a manner that radial movement of the sliding disks within the pockets is prevented, while rotation of the sliding disks within the pockets is permitted.

Further objects, features and other aspects of this invention will be understood from the following detailed description of the preferred embodiments of this invention referring to the annexed drawings.

DETAILED DESCRIPTION OF PREFERRED EMBODIMENT

Figure 1:
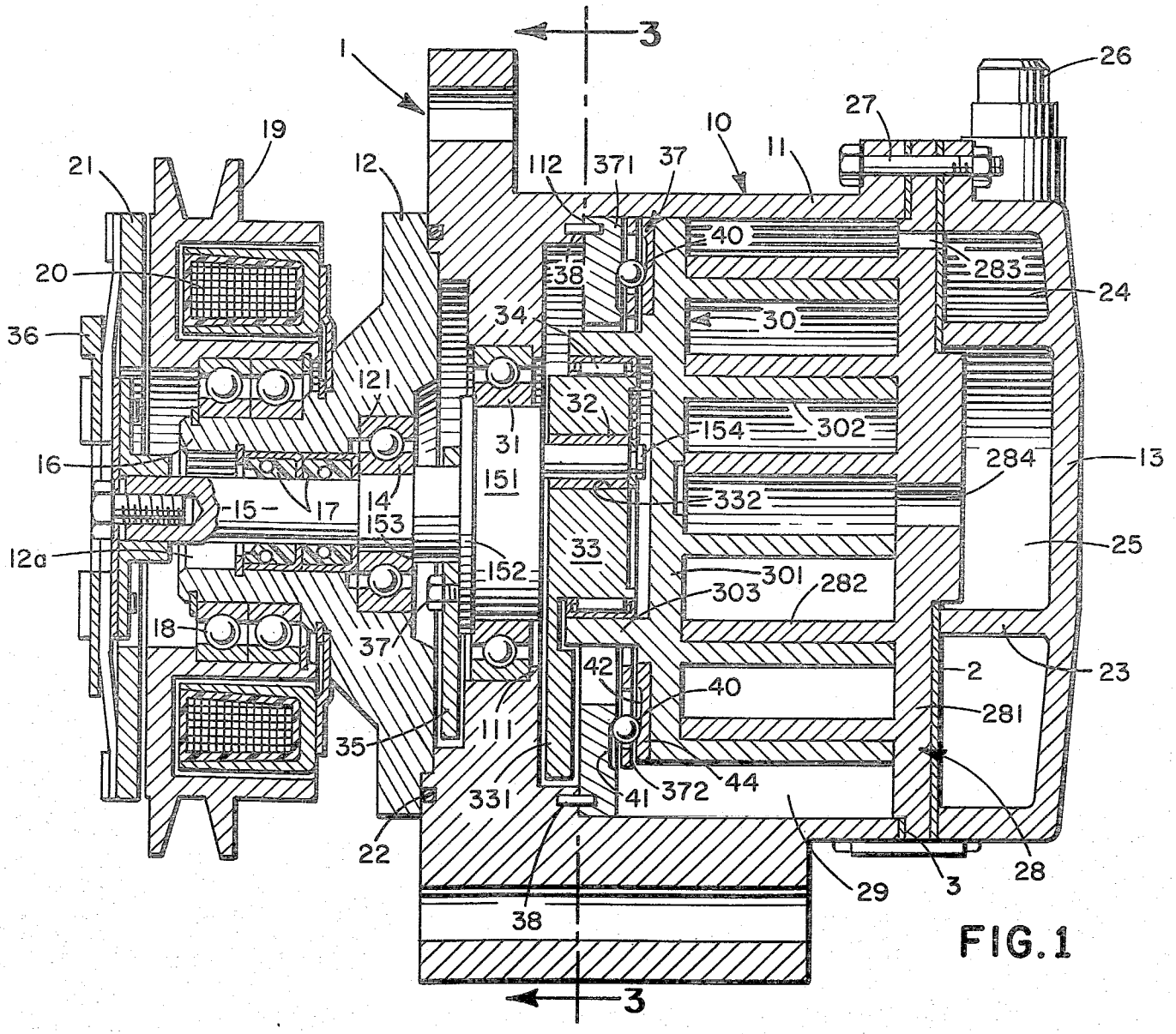
FIG. 1 shows a vertical sectional view of a compressor unit of the scroll type according to an embodiment of this invention.

Referring to FIG. 1, a fluid displacement apparatus in accordance with the present invention, in particular a refrigerant compressor unit 1 of an embodiment of the present invention is shown. The unit 1 includes a compressor housing 10 comprising a cylindrical housing 11, a front end plate 12 disposed to front end portion of the cylindrical housing 11 and a rear end plate 13 disposed to a rear end portion of the cylindrical housing 11. An opening is formed in front end plate 12 and a drive shaft 15 is rotatably supported by a ball bearing 14 which is disposed in the opening. Front end plate 12 has a sleeve portion 16 projecting from the front surface thereof and surrounding drive shaft 15 to define a shaft seal cavity. A shaft seal assembly 17 is assembled on drive shaft 15 within the shaft seal cavity. A pulley 19 is rotatably supported by a bearing means 18 which is disposed on outer surface of sleeve portion 16. An electomagnetic annular coil 20 is fixed to the outer surface of sleeve portion 16 and is received in an annular cavity of the pulley 19. An armature plate 21 is elastically supported on the outer end of the drive shaft 15 which extends from sleeve portion 16. A magnetic clutch comprising pulley 19, magnetic coil 20 and armature plate 21 is thereby formed. Thus, drive shaft 15 is driven by an external drive power source, for example, a motor of a vehicle, through a rotational force transmitting means such as the magnetic clutch.

Front end plate 12 is fixed to a front end portion of cylindrical housing 11 by a bolt (not shown), to thereby cover an opening of cylindrical housing 11 and is sealed by an O-ring 22. Rear end plate 13 is provided with an annular porjection 23 on its inner surface to partition a suction chamber 24 from a discharge chamber 25. Rear end plate 13 has a fluid inlet port 26 and a fluid outlet port (not shown), which respectively are connected to the suction and discharge chambers 24, 25. Rear end plate 13, together with a circular end plate 281, are fixed to the rear end portion of cylindrical housing 11 by a bolt-nut 27. Circular end plate 281 of a fixed scroll member 28 is disposed in a hollow spaced between cylindrical housing 11 and rear end plate 13 and is secured to cylindrical housing 11. Reference numberals 2 and 3 represent gaskets for preventing fluid leakage past the outer perimeter of circular plate 281 and between suction chamber 24 and discharge chamber 25.

Fixed scroll member 28 includes the circular end plate 281 and a wrap means or spiral element 282 affixed to or extending from one side surface of circular plate 281. Circular plate 281 is fixedly disposed between the rear end portion of cylindrical housing 11 and rear end plate 13. The opening of the rear end portion of cylindrical housing 11 is thereby covered by the circular plate 281. Spiral element 282 is disposed in an inner chamber 29 of cylindrical housing 11. Circular plate 281 is provided with a hole or suction port 283 which communicates between suction chamber 24 and inner chamber 29 of cylindrical housing 11.

An orbiting scroll member 30 is also disposed in the chamber 29. Orbiting scroll member 30 also comprises a circular end plate 301 and a wrap means or spiral element 302 affixed to or extending from one side surface of circular plate 301. The spiral element 302 and spiral element 282 of fixed scroll member 28 interfit at an angular offset of 180° and at a determined radial offset. Therefore, a fluid pocket is formed between both spiral element 282, 302. Orbiting scroll member 30 is connected to a drive mechanism and to a rotation preventing mechanism. These last two mechanisms effect orbital motion at circular radius Ro by rotation of drive shaft 15, to thereby compress fluid passing through the compressor unit.

Generally, radius Ro of orbital motion is given by $$\frac{(\text{pitch of spiral element}) - 2(\text{wall thickness of spiral element})}{2}$$

The spiral element 302 is placed radially offset from the spiral element 282 of fixed scroll member 28 by the distance Ro. Thereby, orbiting scroll member 30 is allowed to make the orbital motion of a radius Ro by the rotation of drive shaft 15. As the scroll member 30 orbits, the line contact between both spiral elements 282, 302 shifts to the center of the spiral elements along the surface of the spiral elements. Fluid pockets defined between the spiral elements 282, 302 move to the center with a consequent reduction of volume, to thereby compress the fluid in the pockets. A hole or discharge port 282 is formed through the circular plate 281 at a position near to the center of spiral element 282 and is connected to discharge chamber 25. Therefore, fluid or refrigerant gas, introduced into chamber 29 from external fluid circuit through inlet port 26, suction chamber 24 and hole 283 is taken into fluid pockets fromed between both spiral elements 282, 302. As scroll member 30 orbits, fluid in the fluid pockets is compressed and the compressed fluid is discharged into discharge chamber 25 from the fluid pocket of the spiral element center through hole 284 and therefrom, discharged through an outlet port to an external fluid circuit, for example, a cooling circuit.

Figure 2:
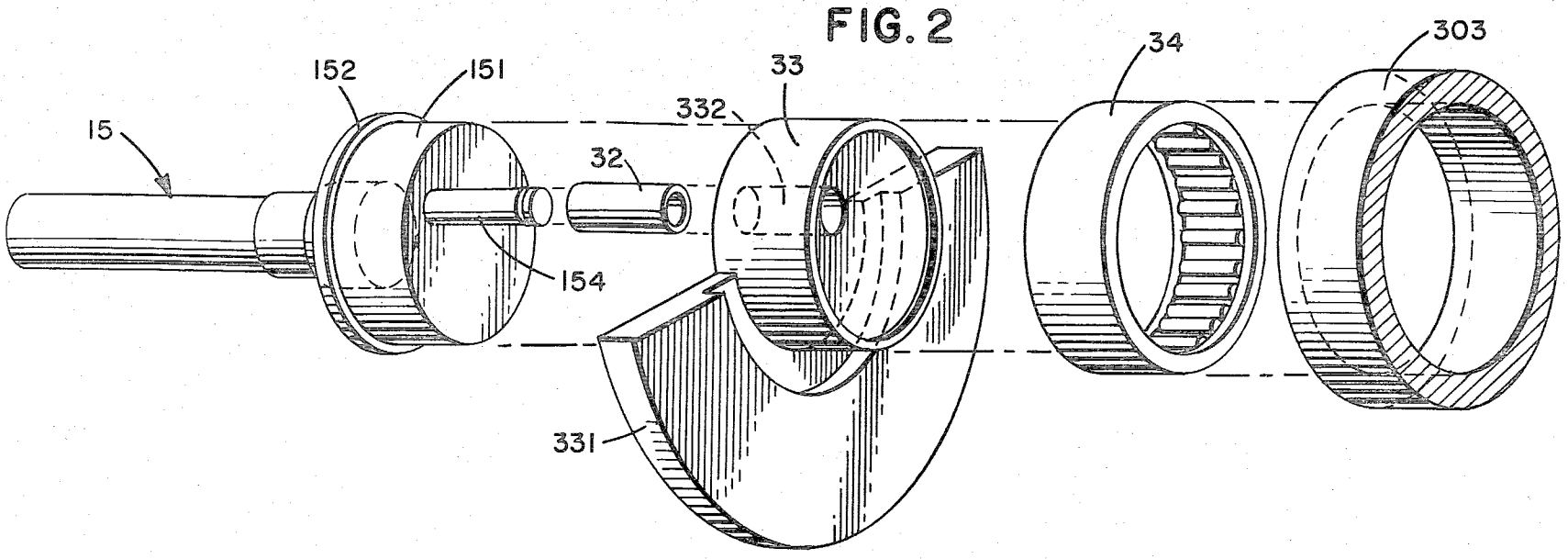
FIG. 2 is an exploded perspective view of the driving mechanism in the embodiment of FIG. 1.
Figure 3:
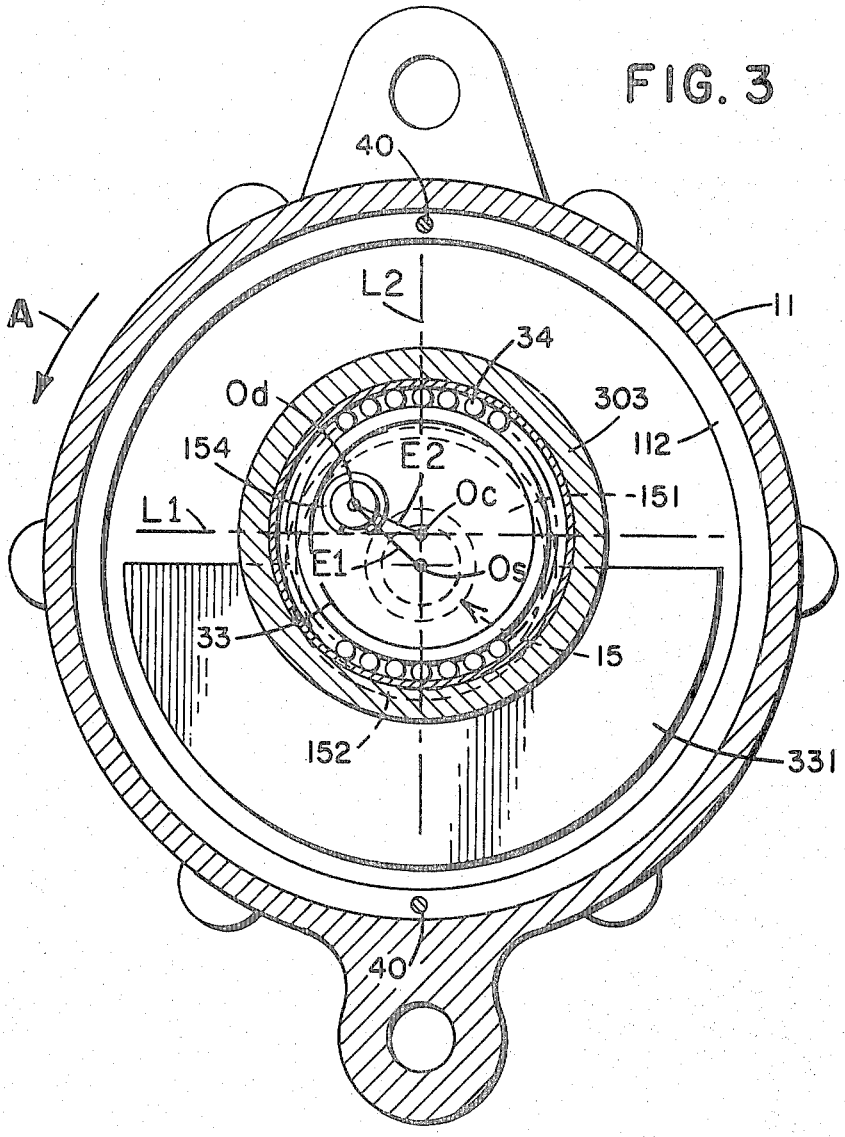
FIG. 3 is a sectional view taken along line III—III in FIG. 1.

Referring to FIGS. 1, 2 and 3 a driving mechanism of orbiting scroll member 30 will be described. Drive shaft 15, which is rotatably supported by front end plate 12 through a ball bearing 14 is formed with a disk portion 151. Disk portion 151 is rotatably supported by ball bearing 31 which is disposed in a front end opening of cylindrical housing 11. An inner ring of the ball bearing 31 is fitted against a collar 152 formed with disk portion 151, and the other outer ring is fitted against a collar 111 formed at front end opening of cylindrical housing 11. An inner ring of ball bearing 14 is fitted against a stepped portion 153 of driving shaft 15 and an outer ring of ball bearing 14 is fitted against a shoulder portion 121 of an opening of front end plate 12. Therefore, drive shaft 15 and ball bearings 14, 31 are supported for rotation without axial motion.

A crank pin or drive pin 154 axially projects from an end surface of disk portion 151 and is radially offset from the center of drive shaft 15.

Circular plate 301 of orbiting scroll member 30 is provided with a tubular boss 303 axially projecting from an end surface of circular plate 301. The spiral element 302 extends from an opposite end surface of circular plate 301. A discoid or short axial bushing 33 is fitted into boss 303, and rotatably supported therein by bearing means, such as a needle bearing 34. Bushing 33 has a balance weight 331 which is shaped as a portion of a disc or ring and extends radially from the bushing 33 along a front surface thereof. An eccentric hole 332 is formed in the bushing 33 radially offset from center of the bushing 33. Drive pin 154 is fitted into the eccentrically disposed hole 332. Bushing 33 is therefore driven by the revolution of drive pin 154 and permitted to rotate by a needle bearing 34.

Respective placement of center Os of shaft 15, center Oc of bushing 33, and center Od of hole 332 and thus of drive pin 154, is shown in FIG. 3. In the position shown in FIG. 3, which positioning is shown there for purposes of explanation, the distance between Os and Oc is the radius Ro of orbital motion, and when drive pin 154 is fitted to eccentric hole 332, center Od of drive pin 154 is placed, with respect to Os, on the opposite side of a line $L_1$, which is through Oc and perpendicular to a line $L_2$ through Oc and Os, and also beyond the line through Oc and Os in direction of rotation A of shaft 15.

In this construction of a driving mechanism, center Oc of bushing 33 is permitted to swing about the center Od of drive pin 154 at a radius $E_2$. When drive shaft 15 rotates drive force is exerted at the center Od to the left and reaction force of gas compression appears at the center Oc to the right, both forces being parallel to line $L_1$. Therefore, the arm Od-Oc can swing outwardly by the creation of the moment generated by the two forces. Therefore, spiral element 302 of orbiting scroll member 30 is forced toward spiral element 282 of fixed scroll member 28, and orbiting scroll member 30 orbits with the radius Ro around center Oc of drive shaft 15. The rotation of orbiting scroll member 30 is prevented by rotation preventing mechanism, described more fully hereinafter, whereby orbiting scroll member 30 orbits and keeps its relative angular relationship. The fluid pockets move because of the orbital motion of orbiting scroll member 30, to thereby compress the fluid.

When orbiting scroll member 30 is driven through bushing 33 having eccentric hole 332, an urging force which acts at line contact between both spiral element 282, 302 will be automatically derived from the reaction force of compressing fluid, whereby seal of the fluid pockets is attained. In addition, center Oc of bushing 33 is rotatable around center Od of drive pin 154, therefore, if a pitch of a spiral element or a wall thickness of a spiral element, due to manufacturing inaccuracy or wear, has a dimentional error, distance Oc-Od can change to correspond the error. Orbiting scroll member 30, thereby, moves smoothly along the line contacts between the spiral elements. The orbital motion of orbiting scroll member 30, bearing 34 and bushing 33 causes a centrifugal force $F_1$.

A balance weight 331 is provided to cause centrifugal force $F_2$ by its rotation. The mass and location of balance weight 331 are selected so that the centrifugal force $F_2$ is equal in magnitude and opposite in direction to the centrifugal force $F_1$. Therefore the centrifugal force $F_1$ which is caused by the orbital motion of orbiting scroll member 30, bearing 34, bushing 33 will be cancelled by the centrifugal force $F_2$, since the force $F_1$, is equal in magnitude and opposite in direction to the force $F_2$.

In the embodiment shown in FIG. 1, drive shaft 15 is provided with a pair of balance weights 35, 36 to prevent vibration caused by moment about the axis of shaft 15 created by centrifugal forces $F_1$, $F_2$. The balance weights 35, 36 are sized and arranged so that the moment of centrifugal forces $F_1$, $F_2$ is cancelled by the moment of centrifugal forces caused by balance weights 35, 36.

Figure 4:
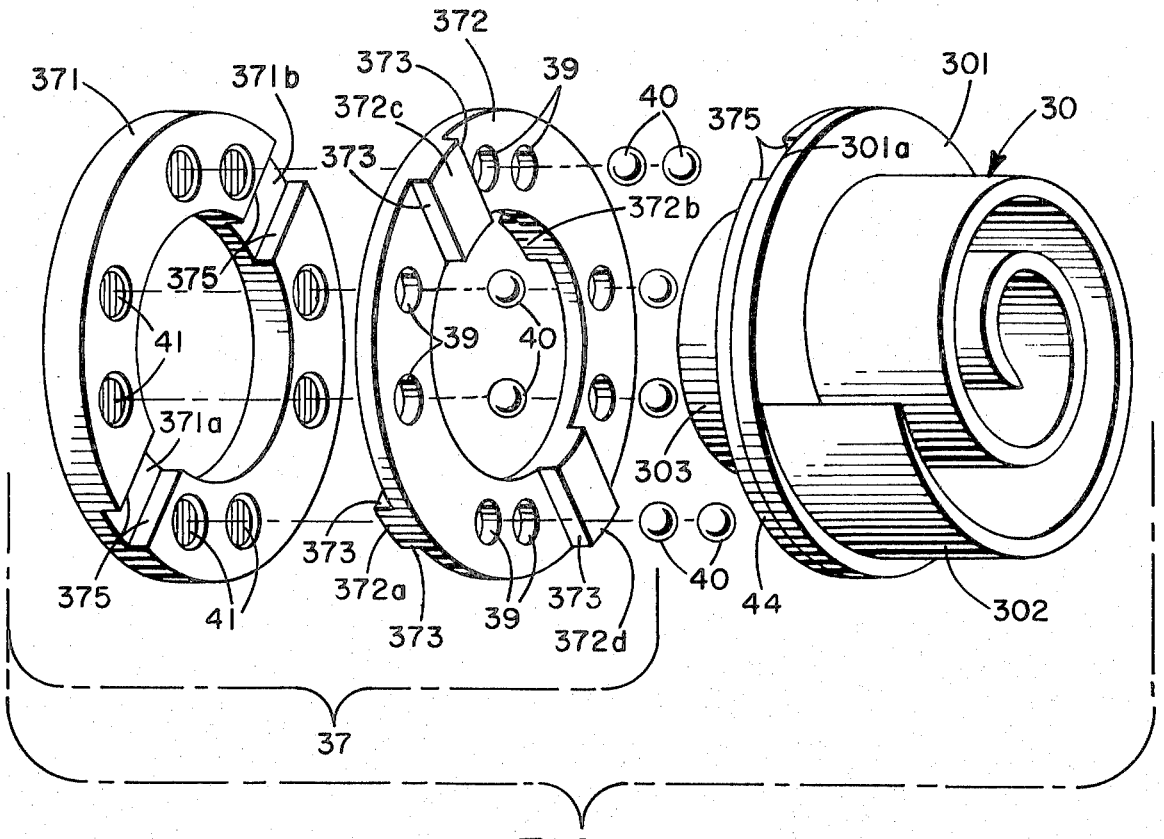
FIG. 4 is an exploded perspective view of an embodiment of a rotation preventing mechanism of this invention.

Referring to FIG. 4 and FIG. 1, a rotation preventing means 37 will be described. Rotation preventing means 37 is disposed to surround boss 303 and is comprised of a fixed ring 371 and a sliding ring 372. Fixed ring 371 is secured to a stepped portion 112 of the inner surface of cylindrical housing 11 by pins 38. Fixed ring 371 is provided with a pair of keyways **371*a*, 371*b* in an axial end surface facing orbiting scroll member 30. Sliding ring 372 is disposed in a hollow space between fixed ring 371 and circular plate 301 of orbiting scroll member 30. Sliding ring 372 is provided with a pair of keys 372*a*, 372*b* on the surface facing fixed ring 371, which are received in keyways 371*a*, 371*b*. Therefore, sliding ring 371 is slidable in the radial direction by the guide of keys 372*a*, 372*b* within keyways 371*a*, 371*b*. Sliding ring 372 is also provided with a pair of keys 372*c*, 372*d* on its opposite surface. Keys 372*c*, 372*d* are arranged along a diameter perpendicular to the diameter along which keys 372*a*, 372*b* are arranged. Circular plate 301 of orbiting scroll member 30 is provided with a pair of keyways (one of which is shown as 301*a* in FIG. 4) on a surface facing sliding ring 372 in which are received keys 372*c*, 372*d*. The keyways of circular plate 301 are formed outside the diameter of boss 303. Therefore, orbiting scroll member 30 is slidable in radial direction by guide of keys 372*c*, 372*d* within the keyways of the circular plate 301**.

Accordingly, orbiting scroll member 30 is slidable in one radial direction with sliding ring 372, and is slidable in another radial direction independently. The second sliding direction is perpendicular to the first radial direction. Therefore, orbiting scroll member 30 is prevented from rotation, but is permitted to move in two radial directions perpendicular to one another.

The keys **372*a–d* are fixed in position on the sliding ring 372, and are preferably formed integral with the ring 372. The keys 372*a–d* each have radially extending outer surfaces or edges 373 transverse to the major surfaces of the keys which face the ring 371 and the plate 301. The edges 373 are flat along their entire length and mate with flat surfaces or edges 375** of the keyways within which they are slidably received.

According to this invention, sliding ring 372 is provided with a plurality of circular holes or pockets 39, except in the portion of the ring 372 where keys **372*a–d* are formed. Pockets 39 penetrate axially and are suitably spaced between adjacent keys about the perimeter of the ring 372. Each of the pockets 39 retain a bearing element such as a ball 40. The diameter of each ball 40 is greater than the thickness of sliding ring 372. Therefore, the spherical surface of ball 40 usually is in contact with and rolls on the surface of fixed ring 371 and circular plate 301. The thrust load from orbiting scroll member 30 is thus supported on fixed ring 371 through balls 40**.

Sliding ring 371 is in reciprocating motion in one radial direction, therefore, if the diameter of ball 40 is selected to be the same as the diameter of pockets 39, the ball 40 can not make rolling motion contact with regard to both surfaces of ring 371 and plate 301, and sliding motion arises. Whereby, the race surface of fixed ring 371 or circular plate 301 might be damaged, or balls 40 might be damaged due to a flaking problem. Therefore, the diameter of pockets 39 must be selected so that ball 40 will making rolling motion while following the orbital motion of orbiting scroll member 30. Minimum diameter dp of pockets 39 in which ball 40 is permitted rolling movement while following the orbital motion of orbiting scroll member 30 is given by $dp=Ro+db$, where db is the diameter of ball 40 and Ro is the radius of the orbital motion of orbiting scroll member 30. Because ball 40 is placed between fixed ring 371 and orbiting scroll member 30, and orbiting scroll member 30 makes an orbital motion with radius Ro, the traveling radius of ball 40 with regard to the race surface of the fixed ring 371 is half of the radius of orbital motion of orbiting scroll member 30, in turn, it is easily seen that the diameter of pockets 39, which must permit the rolling motion of ball 40, is the sum of the radius Ro of orbital motion and the diameter db of ball 40.

In accordance with the above embodiment of rotation preventing means 37, the race surfaces of fixed ring 371 and circular plate 301 may be formed in a flat surface and more than three balls 40 may be used. In this case, the ball 40 does not always move in a circular locus of movement by action of gravity on the ball or other force such as a centrifugal force due to ball movement. In this condition, ball 40 may strike the inner wall of pockets 39 and thereby damage the inner wall of pockets 39 or the ball itself.

Figure 5A:
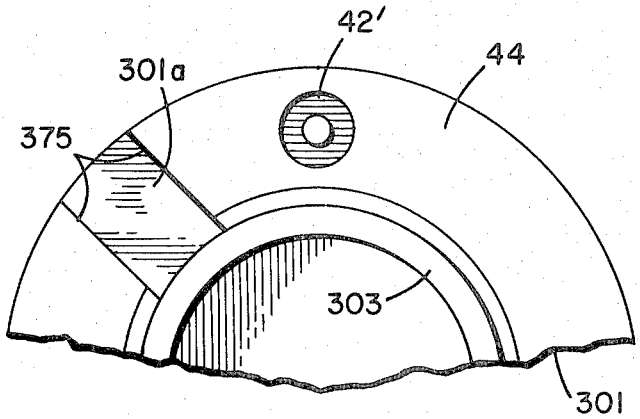
FIGS. 5(*a*) and 5(*b*) are respectively plan and sectional views of a fixed ring of a rotation preventing mechanism.
Figure 5B:
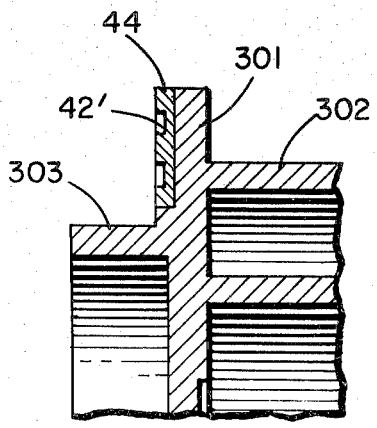

Whereupon, in accordance with the present invention as shown in FIG. 1 and FIG. 4 the surfaces of fixed ring 371 and circular plate 301, which opposes across the ball 40, are provided with circular indentations 41, 42 for receiving balls 40. The indentations have circular perimeters and preferably a flat bottom. A diameter dr of each indentation 41, 42 is defined as $(Ro+x)$, where x is selected smaller than the diameter db of ball 40 corresponding to the depth of indentation and/or slope of annular wall to permit the required roll motion of the traveling radius with regard to fixed ring 371 and circular plate 301 of orbiting scroll member 30. Thereby, ball 40 usually moves almost in contact along the edge of both indentations 41, 42 and the locus of the ball 40 on the fixed ring 371 and circular plate 301 can be circular. From this context, the shape of the indentation on the ring 371 and plate 301 may be an annular groove rather than circular concave. FIG. 5 shows such an embodiment in which an annular groove 42' is formed on the surface of circular plate 301 and/or on the surface of fixed ring 371. The outer diameter of groove 42' is equal to the diameter dr of circular concavities 41, 42 and width of groove is selected as x. Thereby, inner diameter of groove 42' is given by $(dr-2x)=(Ro-x)$.

Figure 6:
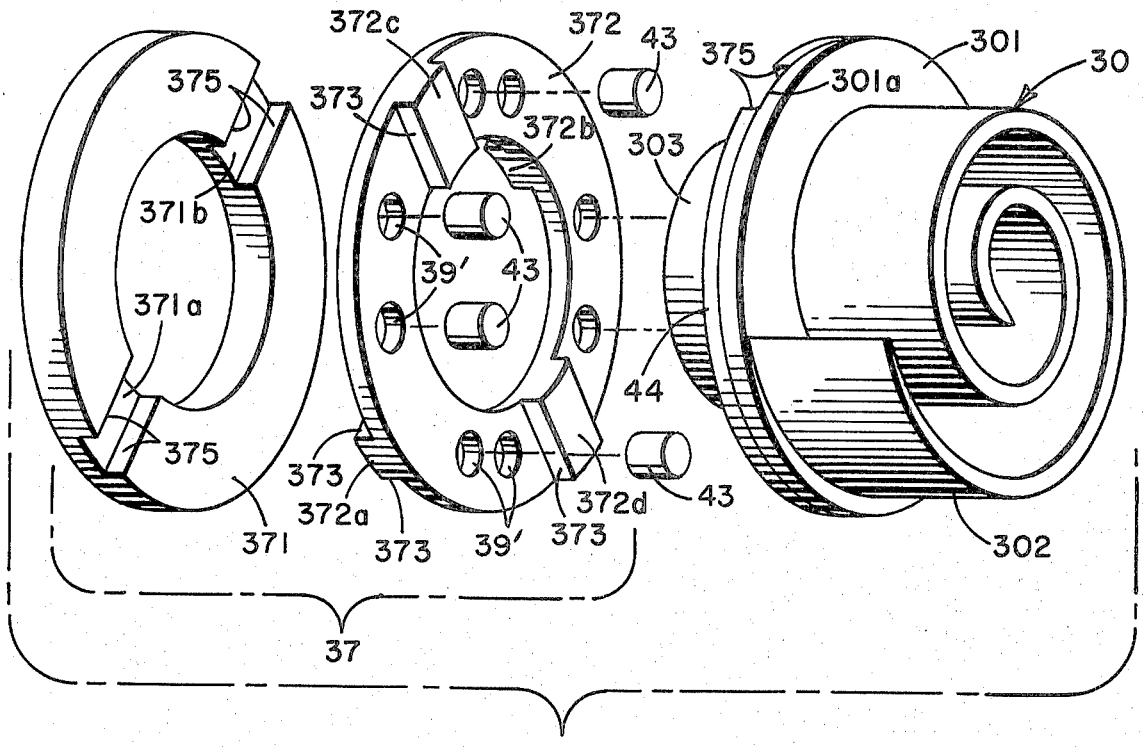
FIG. 6 is a view similar to FIG. 4, illustrating another embodiment of a rotation preventing mechanism.
Figure 7:
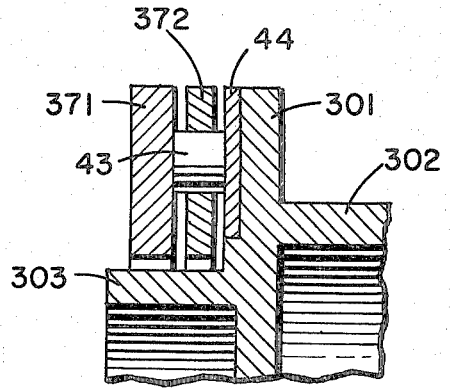
FIG. 7 is a sectional view through the rotation preventing mechanism of FIG. 6.

Referring to FIG. 6 and FIG. 7, another embodiment is shown. This embodiment is directed to a modification of the thrust bearing elements between orbiting scroll member 30 and fixed plate 371. Sliding ring 372 is provided with the plurality of pockets 39' each of which holds a cylindrical sliding disk 43 as a substitute for balls 40 shown in FIG. 1 and FIG. 4. Both end surfaces of sliding disk 43 contact the facing surfaces of fixed ring 371 and circular plate 301.

The thickness of sliding disk 43 is greater than the thickness of sliding ring 372, and diameter of sliding disk 43 is selected equal or slightly smaller than the diameter of pockets 39', in order to prevent the radial movement thereof. If the diameter of sliding disk 43 is smaller than the diameter of pockets 39', rotation of the sliding disk therein is permitted.

According to this construction, the thrust load from orbiting scroll member 30 is supported on the fixed ring 371 through sliding disks 43.

The end surfaces of sliding disks 43 contact with the surface of fixed ring 371 and circular plate 301, and the sliding disks 43 thereby slide thereon. Whereby, it is desirable that sliding disks 43 and the surface of fixed ring 371 and circular plate 301 be comprised of a bearing metal or aluminum alloy, lead, bronze or a self-lubricating metal or that an adequate coating with sliding bearing capability be applied to the base material such as steel.

If orbiting scroll member 30 or sliding ring 371 is made of aluminum or an aluminum alloy to reduce weight of compressor units, the surface of circular plate 301 or sliding ring 371 may easily be worn out by the contact of ball 40 or sliding disks 43 which receive the thrust load from orbiting scroll member 30. Whereby, it is desirable that sheet metal 44 made of material such as the bearing metal, be disposed as the contact surface of one or both of the circular plate 301 and the fixed ring 371.

As seen in FIG. 4 and FIG. 6 the pockets 39 and 39' are located along generally the same circumference as the keys 372. More particularly, the center of the pockets 39, 39' are located substantially on a circumferential line passing through the center of the keys 372*a–d* in a radial direction. The guiding effect of the key 372*a–d* and the thrust bearing effect of the balls 40 or the sliding disks 43 are thereby located on substantially the same circumference, which is adjacent the outer perimeter of the orbiting scroll member 30.

Figure 8:
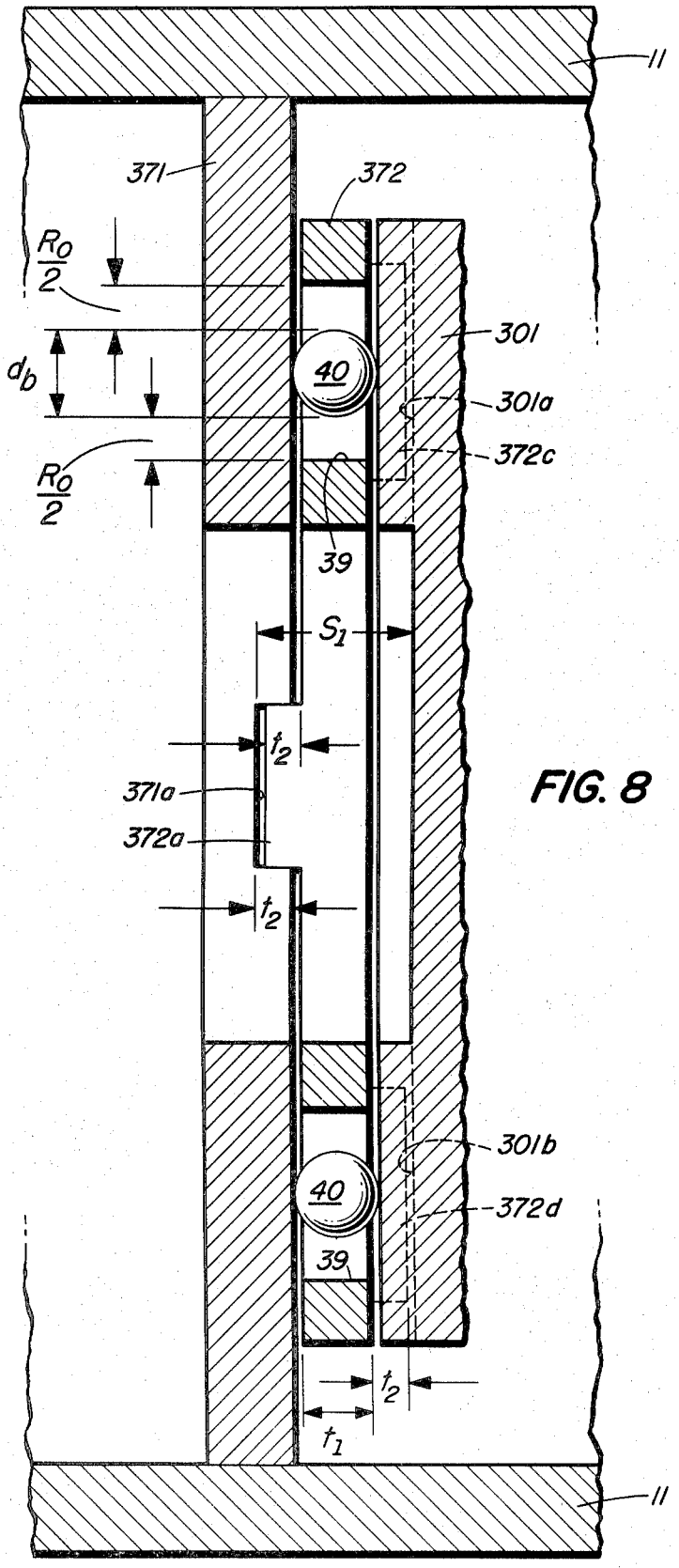
FIG. 8 is a diagramatic cross-sectional view of an embodiment of a rotation preventing mechanism, illustrating relative spacing and dimensions of the elements of the mechanism.

As illustrated in FIG. 8, a bearing element, in the form of a ball 40, is dimensioned relative to the spacing between the keyways 371*a–b*, 301*a–b*, and relative to the total dimension of the ring 372 between the outer surfaces of opposing keys 372*a–b* and 372*c–d* such that the axial thrust of the orbiting scroll member during normal orbiting motion is received totally by the bearing elements and, hence, not by keys. The diameter of ball 40, and hence, the space between fixed ring 371 and the circular plate 301 of orbiting scroll member 30 is shown as db. In FIG. 8, the bearing element is shown in contact with a flat surface of the fixed ring 371 and of the circular plate 301 of orbiting scroll member 30. In other embodiments, the bearing element can be received within an indentation or annular groove. The space between the outermost or bottommost surfaces of the keyways 371*a–b*, 301*a–b* is shown as $S_1$. The height or thickness of each key is shown as $t_2$, and the thickness of the remaining portion of the sliding ring 372 is shown as $t_1$. The depth of the keyways 371*a–b*, 301*a–b* can be equal to $t_2$. So that the axial thrust is received soley by bearing elements during normal orbiting of motion, the overall thickness of the sliding ring 372 and the keys extending therefrom is less than the spacing between facing keyways 371*a–b*, 301*a*, i.e. $t_1+2t_2$ is less than $S_1$; and with the depth of the keyways equal to the thickness of the keys $S_I=d_b+2t_2$ so that the spacing is maintained when $t_I<d_b$.

This invention has been described in detail in connection with preferred embodiments, but these are examples only and this invention is not restricted thereto. It will be easily understood by those skilled in the art that the other variations and modifications can be easily made within the scope of this invention.

What is claimed is:

1. In a scroll-type fluid displacement apparatus including a housing having a fluid inlet port and a fluid outlet port, a fixed scroll fixedly disposed relative to said housing and having end surface from which first wrap extends into the interior of said housing, an orbiting scroll having an end plate from which second wrap extends, and said first and second wraps interfitting at an angular offset to make a plurality of line contacts to define at least one pair of sealed off fluid pockets, a drive mechanism connected to said oribiting scroll for transmitting orbital motion to said orbiting scroll, and rotation preventing means for preventing rotation of said orbiting scroll during the orbital motion of said orbiting scroll, whereby said fluid pockets change volume by the orbital motion of said orbiting scroll, the improvement comprising said rotation preventing means comprising a fixed ring disposed within said housing spaced from and opposed to said end plate and a sliding ring which is slidably connected to said fixed ring by keys and keyways for permitting motion in a first direction of a diameter and slidably connected to said end plate by keys and keyways for permitting motion in a second direction of a diameter perpendicular to said first direction, and said sliding ring having formed in it a plurality of pockets which penetrate axially and are circumferentially spaced, and said pockets retaining bearing elements for transmitting axial thrust load from said orbiting scroll to said fixed ring, said bearing elements being sized relative to said sliding ring, keys and keyways so that the axial thrust load is transmitted solely by said bearing elements, and the rotation of said orbiting scroll is prevented by said keys and keyways.

2. The improvement as claimed in claim 1, wherein said bearing elements comprise balls.

3. The improvement as claimed in claim 2, wherein a diameter of said pockets is the same or greater than the sum of radius Ro of orbital motion and the diameter of said ball.

4. The improvement as claimed in claim 2 or 3, wherein said fixed ring and end plate are each provided with a plurality of circular indentations, each for receiving one of said balls.

5. The improvement as claimed in claim 4, wherein a diameter of said circular indentation is greater than the radius Ro of orbital motion.

6. The improvement as claimed in claim 2 or 3, wherein said fixed ring and end plate means are each provided with a plurality of annular grooves, each for receiving one of said balls.

7. The improvement as claimed in claim 6, wherein an outer diameter of said annular groove is equal to the sum of the radius Ro of orbital motion and a distance less than the diameter of the balls, and wherein the width of said groove is less than the diameter of said balls.

8. The improvement as claimed in claim 1, wherein said bearing elements comprise cylindrical pins or circular disks.

9. The improvement as claimed in claim 8, wherein the diameter of said pockets is substantially the same as said diameter of said cylindrical pins or circular disks.

10. The improvement as claimed in claim 1, wherein sheet metal is disposed on the surface of said end plate means.

11. The improvement as claimed in claim 10, wherein said end plate is formed of aluminum or aluminum alloy.

12. The improvement as claimed in claim 1 or 11, wherein said fixed ring is formed of aluminum or aluminum alloy.

13. The improvement as claimed in claim 1, wherein the pockets are located along generally the same circumference as said keys.

14. The improvement as claimed in claim 13, wherein the centers of said pockets are located substantially along a circumferential line passing through the center of said keys in a radial direction.

15. The improvement as claimed in claim 14 wherein said circumferential line is located adjacent the outer perimeter of said orbiting scroll member.

16. The improvement as claimed in claim 1, 13, 14 or 15 wherein said keys have radially extending edges transverse to their major faces, said edges being substantially flat along their entire extent.

17. The improvement as claimed in claim 17 wherein said keys are formed integral with said sliding ring.

18. The improvement as claimed in claim 13, 14 or 15 wherein said fixed ring is formed discrete from said housing, and including means for fixedly securing said fixed ring within said housing.

19. The improvement as claimed in claim 1 wherein said keys extend from said sliding ring and said keyways are formed in said fixed ring and said end plate, the overall thickness of the sliding ring and keys extending therefrom is less than the spacing between facing keyways in said fixed ring and said end plate, the thickness of said keys is equal to the depth of said keyways, and the thickness of said sliding ring is less than the length of the bearing elements between their contact points with the fixed ring and the end plate.

20. A fluid displacement apparatus comprising:

a housing having a fluid inlet port and a fluid outlet port;

a fixed scroll fixedly disposed with respect to said housing and having first end surface from which a first wrap extends into the interior of said housing;

an orbiting scroll movably disposed within said housing and having end plate from which a second wrap extends, said first and second wraps interfitting at an angular offset to make a plurality of line contacts to define at least one pair of sealed off fluid pockets;

drive means for imparting orbiting motion to said orbiting scroll;

rotation preventing means for preventing rotation of said orbiting scroll during the orbital motion of said orbiting scroll, said rotation preventing means including a fixed ring fixedly disposed within said housing spaced from and opposed to said end plate and a sliding ring slidably connected to said fixed ring by keys and keyways for permitting motion in a first direction of a diameter and slidably connected to said end plate by keys and keyways for permitting motion in a second direction of a diameter perpendicular to said first direction;

a plurality of circumferentially spaced pockets formed axially through said sliding ring;

a bearing element received within each of said pockets for transmitting axial thrust load from said orbiting scroll member to said fixed ring, said pockets being located along generally the same circumference as said keys and being adjacent to the outer perimeter of said orbiting scroll member, said bearing elements being sized relative to said sliding ring, keys and keyways so that the axial thrust load is transmitted solely by said bearing elements, and the rotation of said orbiting scroll is prevented by said keys and keyways.

21. An apparatus claimed in claim 20 wherein the centers of said pockets are locates along a circumferential line passing through the center of said keys in a radial direction.

22. An apparatus as claimed in claim 20 wherein said keys are formed integral with said sliding ring and have radially extending edges transverse to their major faces, said edges being substantially flat along their entire extent.

23. An apparatus as claimed in claim 20 wherein said keys extend from said sliding ring and said keyways are formed in said fixed ring and said end plate, the overall thickness of the sliding ring and keys extending therefrom is less than the spacing between facing keyways in said fixed ring and said end plate, the thickness of said keys is equal to the depth of said keyways and the thickness of said sliding ring is less than the length of the bearing elements between their contact points with the fixed ring and the end plate.

* * * * *

UNITED STATES PATENT AND TRADEMARK OFFICE

CERTIFICATE OF CORRECTION

PATENT NO. : 4,406,600

DATED : September 27, 1983

INVENTOR(S) : Kiyoshi Terauchi and Seiichi Sakamoto

It is certified that error appears in the above—identified patent and that said Letters Patent is hereby corrected as shown below:

Column 3, line 46, "porjection" should read --projection--;

Column 3, line 47, "numberals" should read --numerals--;

Column 4, line 39, "fromed" should read --formed--;

Column 7, line 3, "making" should read --make--; and

Claim 21, line 6, "locates" should read --located--.

Signed and Sealed this

*Thirteenth* Day of *December 1983*

[SEAL]

*Attest:*

GERALD J. MOSSINGHOFF

*Attesting Officer*

*Commissioner of Patents and Trademarks*